United States Patent [19]

Alford

[11] 4,031,536

[45] June 21, 1977

[54] STACKED ARRAYS FOR BROADCASTING ELLIPTICALLY POLARIZED WAVES

[76] Inventor: Andrew Alford, 120 Cross St., Winchester, Mass. 01890

[22] Filed: Nov. 3, 1975

[21] Appl. No.: 628,247

[52] U.S. Cl. ..... 343/796; 343/806; 343/890

[51] Int. Cl.[2] ..... H01Q 21/24

[58] Field of Search ..... 343/794, 726, 727, 803, 343/804, 806, 890, 891, 796

[56] References Cited

UNITED STATES PATENTS

| | | | |
|---|---|---|---|
| 3,474,452 | 10/1969 | Bogner | 343/890 |
| 3,665,479 | 5/1972 | Silliman | 343/891 |
| 3,829,864 | 8/1974 | Truskanov et al. | 343/890 |

*Primary Examiner*—Eli Lieberman

[57] ABSTRACT

Improved performance of a stacked array of short helical elements is achieved by using average spacing between elements which is less than one wavelength. Still better performance is obtained by using as antenna elements structures comprising combinations of Z-shaped radiators.

10 Claims, 11 Drawing Figures

STACKED ARRAYS FOR BROADCASTING ELLIPTICALLY POLARIZED WAVES

This invention relates to antenna arrays used in broadcasting of FM and other signals. In particular it is related to arrays comprising a number of element antennas which are stacked one above another and which are intended to broadcast elliptically polarized signals. Individual antennas which serve as elements in the stacked array may be of different types. For example, an element may comprise a single turn helix, a group of crossed dipoles, or it may have other shapes described in detail in this specification.

The purpose of using a number of elements in a stacked array is to increase the gain of the array, that is, to send more signal toward the outlying communities for the same amount of power delivered to the antenna. It is well known that the gain of a stacked array depends on four factors: The radiation characteristic of an element, the spacing between the elements, on the distribution of power among the elements in the array and on the phases of the currents in the elements.

In U.S. Pat. No. 2,289,856 I disclosed the optimum spacing for omnidirectional loops used as elements in a stacked array, assuming that in the vertical planes, passing thru the vertical axis of the loop, the radiation pattern of the loop has the shape of a figure of eight, that is, the cosine theta pattern as described in U.S. Pat. No. 2,306,113. On this assumption I had shown that the best spacing between such loops would be around 320°–360° electrical degrees. Since the 360° spacing was found to simplify the feeding harness it came into rather wide use.

Since the advent of elliptical polarization in FM broadcasting, (often referred to as "circular polarization"), the horizontally polarized signals delivered by mast mounted loops were replaced by elliptically polarized signals delivered by various forms of antennas more or less equivalent to a short helix which, except for the distortion by the metal mast and other nearby metal objects radiates elliptically polarized waves although the minor to major axis ratio at some azimuths sometimes approaches a low value and the distribution of vertically polarized radiation in the horizontal plane is only nominally omnidirectional. In an effort to simplify the structure of such an element the relatively uniform distribution of current around the loaded loop was superceeded by current distributions which are anything but uniform. This uneven current distribution results in a substantial deviation from the figure of eight patterns in the vertical planes. In fact, in some planes the typical measured vertical patterns of the horizontally polarized signal from a short helix were found to be ovals rather than figures of eight. The result is that both downward and upward radiations from such an element are large and so is the coupling between the elements. Because of this phenomenon the assumption on which the 360° spacing was originally based is not valid for such elements. On the contrary, I find that other, smaller, spacings such as, for example ¾ wavelength spacing are more efficient not only in that they result in either a greater or equal gain per array element and in a smaller aperture for a given number of elements. The smaller aperture is beneficial because it means a shorter mast and therefore, also, smaller overturning moment applied by the mast to the supporting structure under high winds.

Depending upon the details in the shape of the vertical pattern of a short helix, element spacings between 0.50 and 0.85 wavelengths result in an increase in the gain of the array over the array with the same number of helix elements but spaced one wavelength apart. Furthermore, smaller spacing results in a substantial decrease in the overturning moment. I also find that with short helical elements in common use today, an array with one wavelength spacing between these elements results in such a large downward signal as to sometimes cause substantial interference with audio frequency devices in the transmitting station. Such interference is reduced when ¾ wavelength spacing is used in place of the one wavelength spacing and such interference can be almost eliminated by still another arrangement comprising the use of two different spacings between the elements in the same array. In this latter arrangement an even number of elements is used in the array. The elements are arranged in pairs with the elements in a pair spaced ½ wavelength apart. The spacing between the centers of these pairs is made 1 ½ wavelengths. In this arrangement with 2N elements in an array there are N pairs. The sum of spacings between the pairs is $N \times \lambda/2$ where $\lambda$ is one wavelength. The spacing between the upper element of a pair and the lower element of the adjacent pair above is $\lambda$. There are a total of (N−1) such spaces. The total of all spaces between the elements is therefore $N \cdot \lambda/2 + (N-1)\lambda = (1.5N-1)\lambda$. The total number of spaces is 2N−1. Therefore the average spacing is $$S_{average} = \frac{1.5N-1}{2N-1} \cdot \lambda$$

For example, the average spacing for 4, 6, 8 and 10 element arrays are:

| No. of Elements | No. of Pairs | Average Spacing |
|---|---|---|
| 4 | 2 | .667 |
| 6 | 3 | .700 |
| 8 | 4 | .715 |
| 10 | 5 | .722 |

Antenna element of short helix type has a gain which is lower than that of a combination of a vertical half wave radiator and true loop in which the current is constant around the periphery. The lower gain of the single turn helix is due to the fact that it radiates a great deal of energy upward and downward.

When the optimum spacing is used the mutual impedances between the elements are such as to reduce the radiation resistances thus allowing a greater amount of current flowing into the elements for a given amount of delivered power. This results in an increase in the gain of the array. The factor by which the gain can be increased over the array of helical elements with one wavelength spacings may be 1.3 or even 1.45, depending on how much is radiated by the element in the upward and downward directions. It should be kept in mind, however, that the larger factors can be obtained only when the gain of the element itself is low because of the upward and downward radiation. Thus the total gain of an array, per unit length, as measured with respect to say a half wave antenna does not vary very much. The net result of making the average spacing of short helical antennas less than a wavelength is more efficient use of the aperture. It should be kept in mind that the gain per unit length of the overall aperture remains approximately constant for both high and low gain elements. To obtain the same gain it takes a larger number of low gain elements. When larger than optimum spacing is used with low gain elements, not only a lower gain is obtained but also the additional aperture is wasted.

While smaller spacings between antenna elements of the short helix type result in optimum gain, such spacings make it more difficult to obtain the correct power distribution among the elements in the array because of the mutual coupling between the elements. This difficulty can be overcome, for example, by using hybrids or directional couplers which provide isolation. It does, however, result in some increase in the cost of the feeding harness and this cost must be balanced against the savings accrued as a result of the shorter mast and a smaller overturning moment at the base with lesser demand on the strength of the supporting structure.

Another arrangement comprising pairs of elements spaced a half wavelength apart and with pairs spaced, for example, 1 ½ wavelength between their centers results in some saving in the total aperture over an array with one wavelength spacings. Such an array almost completely eliminates upward and downward radiations and requires a simple feeding system.

When an array is to serve a number of FM stations as a master antenna, it must be usable over a relatively wide frequency range. Since elements of the helix type are relatively narrow band devices and since in such service a higher grade coverage is usually required, it is necessary to make use of a more brandband antenna as an element which is capable of radiating elliptically polarized waves with minor to major axes ratio not less than, say, 0.5 and with the horizontal patterns in horizontal and vertical polarizations deviating from a circle by say, not more than ± 2 ½ dB.

In order to avoid the distortion of the horizontal pattern of the vertically polarized signal of an element antenna, it is necessary that the element antenna be built around the mast. Furthermore, in order to decrease the excitation of vertical currents in the mast and in the vertical feeders, it is desirable that the sources of the vertically polarized waves in the element be as far away from the mast as is practicable.

I find that good results are obtained by making use of electrically half wave radiator shaped something like a capital letter "Z" turned so that the normally horizontal parts of the letter Z are made vertical. The central portion of the Z may be horizontal or somewhat inclined to the horizon. An element comprises two such Z radiators placed so that downward pointed end of one Z is in the proximity of, but not in electrical contact with, the upward end of the other Z and the central portions of the two Z's are at approximately the same level. The adjacent ends of the two Z's are energized with an RF frequency by a balanced feeder which may be the balanced end of a balun. The combination of two Z's, together with a balanced feeder, will be referred as a twin-Z element. Two such similar twin-Z elements may be clamped at the same level, on the opposite sides of a mast so that the vertical portions of the two elements are close to each other and are energized simultaneously in phase with respect to each other, so that the currents in the central portions of the four 2-radiators at a given instant all flow in the same sense, say, clockwise. This combination of two twin-Z elements produces in the horizontal plane substantially omnidirectional radiation patterns in all polarizations and over a substantial frequency range.

In the vertical plane the patterns in both the horizontal and vertical polarizations have the shape of a figure of eight with minima of radiation being in the upward and downward directions. The optimum spacing between the antenna elements of this kind is close to one wavelength so that the gain of a stacked array for each polarization is related to the spacing as described in my U.S. Pat. No. 2,289,856.

An objective of this invention is to provide a more efficient spacing between such antenna elements as those of the short helix type which radiate elliptical polarization and radiate a substantial amount of power in upward and downward directions.

Another objective of the invention is to provide an array of elements of the short helix type which results in very small radiation downward and upward in comparison with the radiation going toward the horizon and at the same time makes better use of the available space on the mast than is obtained with conventional 360° spacings.

Still another objective of my invention is to provide a more efficient broad band antenna element for use in stacked arrays intended to provide reasonably circularly polarized radiation distributed substantially equally in all directions around the mast and with very little radiation going upward and downward.

Still another objective of my invention is to provide an efficient stacking arrangement for use with the antenna element of this invention.

Other objects, features and advantages of the present invention will be apparent from the following description of embodiments of the invention which represents the best known use of the invention. These embodiments are shown in the accompanying drawings in which.

Figure 5:
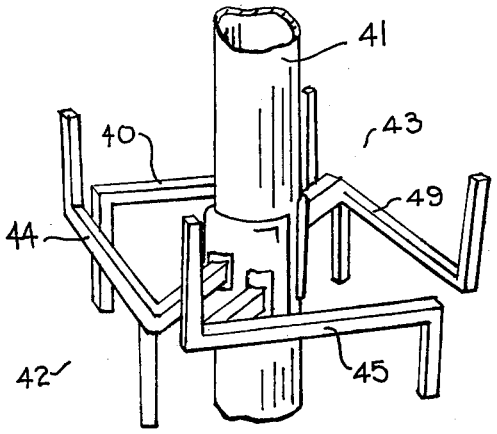
FIG. 5 shows an embodiment of the antenna element of this invention.
Figure 8:
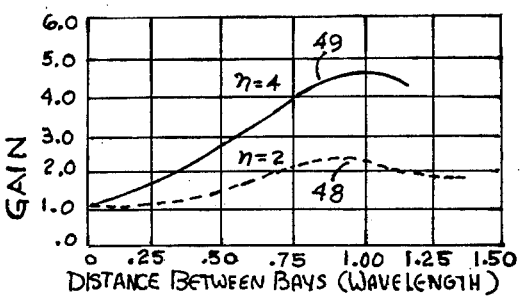
Figure 10:
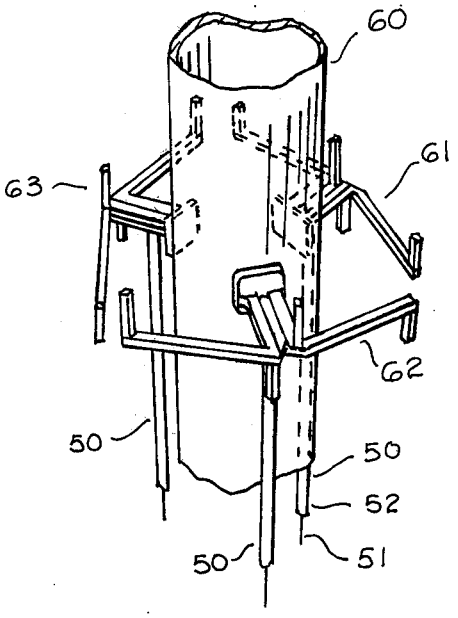

FIG. 8 shows a plot of gain as a function of spacing D for arrays with 2 elements and 4 elements which have figure of eight vertical patterns such as antennas of FIGS. 5 and 10.

Figure 9:
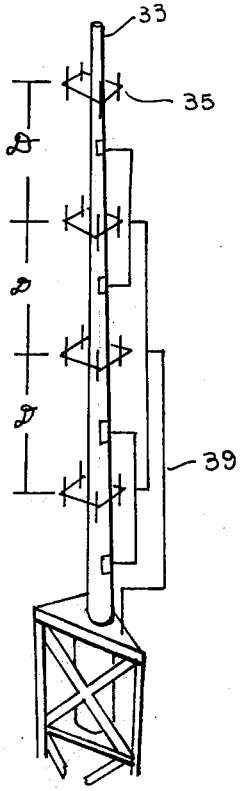

FIG. 9 shows an array of antennas of FIG. 5 fed with a multiple fork feeder.

FIG. 10 shows an antenna comprising three twin-Z elements arranged around a metal mast.

Figure 11:
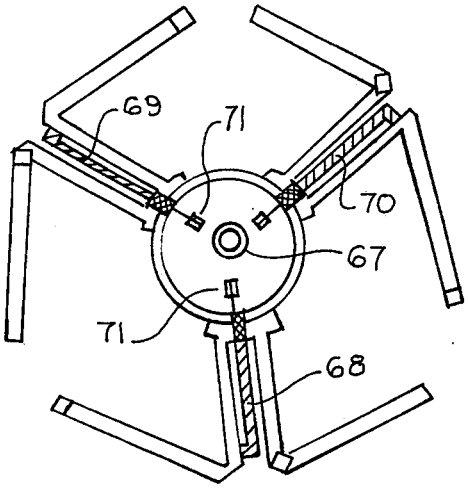

FIG. 11 shows another arrangement for feeding the three twin-Z elements used in the antenna of FIG. 10.

Figure 1:
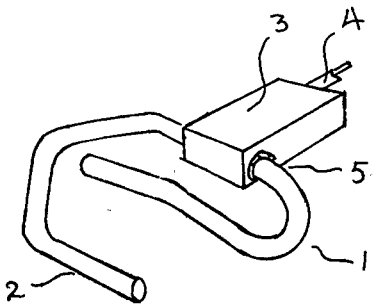
FIG. 1 shows one form of an antenna element of the short helix type which radiates elliptically polarized waves.

FIG. 1 shows a schematic view of an antenna element of the short helix type. The radiating element comprises parts 1 and 2 which are energized by some form of a balun 3 that is in turn supplied with radio frequency power through coaxial feeder 4. In FIG. 1 the two radiating parts of the helix are bent in such a way that the overlapping ends are roughly parallel. In other forms of antennas of short helix type the upper end of the short helix is bent generally upward while the other end is bent generally downward.

The sum of the lengths of conductors 1 and 2 is usually close to ½ wavelength. At 100 MHz the diameter of the structure is therefore less than one-sixth of a wavelength, for example, around 15 inches.

In FIG. 1 the balun is contained in a box which is provided with insulators such as 5 in order to avoid short circuiting the radiators. In some types of baluns no insulators are required. Radiators of the short helix type radiate upward and downward almost as much as toward the horizon. The ratio of the downward signal to the signal in the direction on the horizon was found to be, for example, 4/5 for what is believed to be a typical element. This ratio, however, does depend to some degree on the details of the helix.

Figure 2:
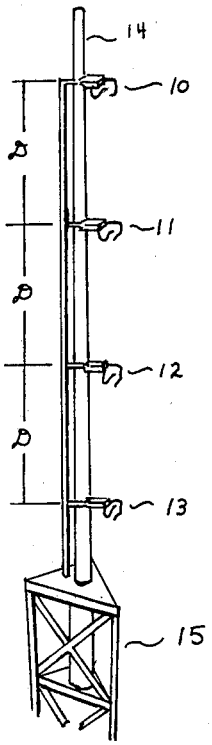
FIG. 2 shows antenna elements of the short helix type mounted one above another on a vertical mast supported by a tower.

FIG. 2 shows a stacked array in which antenna elements 10, 11, 12, 13 of FIG. 1 are mounted one above another on a metal mast 14. This arrangement is obviously asymmetrical in that the antenna elements are located on one side of the mast. Unless such a mast is very large in diameter, for example, more than one-third of the wavelength, the horizontally polarized waves radiated by the antenna elements are not affected a great deal by the presence of the mast 14.

The vertically polarized radiation from the elements induces vertical currents in the mast which result in re-radiation. This re-radiation tends to partially cancel the radiation behind the mast. This effect is influenced, to some degree, by the distance between an element and the mast. The ½ wave spacing is somewhat better than a ¼ wave spacing in this respect. With a mast about one-eighth of a wavelength in diameter, and ¼ wave spacing, the back signal was found to be around 11 dB below the front signal. The ½ wave spacing reduces the front as well as the back signals but results in more radiation to the sides. Since the horizontally polarized radiation from a helical element is usually greatest in the directions here referred to as front and back, it follows that there is substantially more horizontally polarized than vertically polarized signal front and back. To the sides the two signals are either more or less equal or the vertically polarized signal exceeds the horizontally polarized signal. Axial ratio varies with azimuth between 2 and 25 dB.

Figure 3:
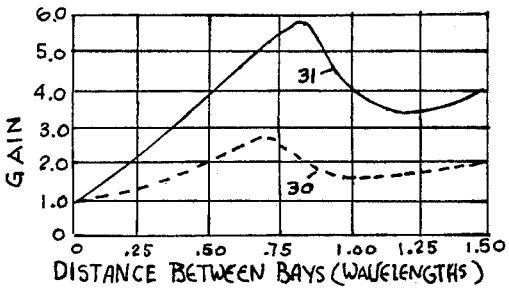
FIG. 3 shows an approximate plot of the array gain as a function of the spacing D between the elements in the array of FIG. 2.

Because of the upward and downward radiation from the antenna elements such as 10, 11, 12 and 13 there is substantial coupling between them. One effect of such large coupling between these elements is to greatly influence the gain of the array with respect to the gain of a single element. This effect is described in connection with FIG. 3. FIG. 3 shows two curves. Curve 30 is for an array of two elements, curve 31 is for a four element array. An inspection of this figure shows that the maximum gains are not obtained at spacings close to one wavelength but are obtained close to ¾ wavelength spacing. This result is not in contradiction with the results shown in FIG. 4 of U.S. Pat. No. 2,289,856 because in that patent the element antennas were assumed to radiate vertical patterns shaped like the figure of eight with nulls in the upward and downward directions, whereas the curves in FIG. 3 relate to the element antennas which send out downward and upward almost as much radiation as they do toward the horizon. When upward and downward radiations are decreased with respect to the radiation toward the horizon, the maxima of the curves in FIG. 3 move in the direction of the one wavelength spacing. The spacings which result in maximum gain for larger arrays comprising, for example, 5, 6, 7 or 10 elements, are close to the spacing shown in FIG. 3 for 4 elements. These spacings for maximum gain fall within the limits of 0.7 and 0.9 wavelengths.

It is noted that according to FIG. 3 the ½ wavelength spacing results in the same gain as the one wavelength spacing. When element antennas 20, 21, . . . , 27 are arranged as in FIG. 4, in which the spacing D between the element antennas in a pair is ½ wavelength, and the spacing D′ between the nearest element antennas of neighboring pairs is one wavelength, we see that the interactions are such as to produce essentially the same gain as one would get by separating the element antennas one wavelength apart as in FIG. 2. From an array in FIG. 2, with four elements spaced one wavelength apart, one would get a gain of 4 using an aperture 3 wavelengths high. With an array of four elements, arranged as in FIG. 4, one would still get the same gain of 4, but this time with a total aperture of 2 wavelengths. Thus the arrangement of FIG. 4 requires a shorter mast for the same gain. It should be pointed out at this point that the values of gain referred to above, and shown in FIG. 3, are with reference to the gain of the element antenna, not with respect to some absolute standard such as an isotropic antenna or a half wave antenna. Furthermore, these values of gain refer to the gain in the horizontal polarization. If a half of the total power delivered to an element goes into horizontal polarization and the other half in vertical polarization, then the total gain of the antenna will be ½ of the value given in FIG. 3, again with respect to the gain of the element antenna.

In the United States, in accordance with the present FCC rules, applicable to FM broadcasting, more power is usually supplied to produce horizontal polarization, so that in that polarization the gain is somewhat greater than one half of the gain shown in FIG. 3. The values in FIG. 3 are approximate and they show only the gain with respect of the element antenna. The gain of an element shown in FIG. 1, in horizontal polarization, if averaged over the horizon, is roughly 0.7 of the gain of a dipole so that in spite of the overshoots at the maxima, in FIG. 3, one gets only modest values of gain with respect to the dipole even at the best spacings.

Figure 6:
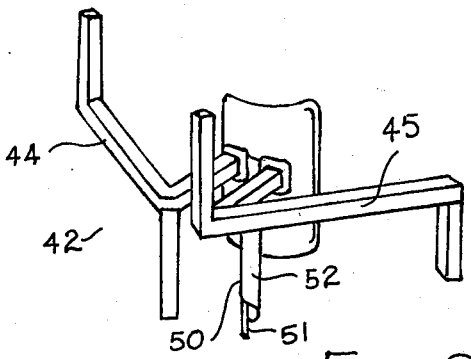
FIG. 6 shows a twin-Z element of the type used in the antenna of FIG. 5.
Figure 7:
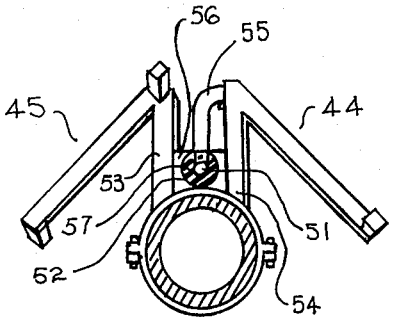
FIG. 7 shows one form of a balun which may be used in the antenna element of FIG. 5.

FIG. 5 shows another embodiment of this invention. In this figure, 41 is a metal mast, to opposite sides of which are clamped two twin-Z elements 42 and 43. A separate view of a twin-Z element is shown in FIG. 6. This twin Z element comprises two Z-shaped radiators 44 and 45. These radiators are fed by means of a balun. One form of this balun is indicated in FIG. 7 in which coaxial line 50 comprises the inner conductor 51 and the outer conductor 52. This line is used to supply power to the balun. The balun comprises metal bars 53, 54 and an inner conductor 55. Said inner conductor 55 is connected or coupled to the inner conductor 51 of the coaxial line 50. The outer conductor 52 of the coaxial line 50 terminates in metal block 56 which is in electrical contact with bars 53, 54 of the balun. Sealing insulator 57 is used to exclude water from the transmission line 50. The lengths of the metal bars 53, 54 are made approximately ⅛ to ¼ wavelength long. The overall lengths of the Z conductors, such as 44, 45 are made approximately ½ wavelength long with the central portion being about one quarter wavelength. The upturned and downturned ends are each about ⅛ wavelength long. The horizontal separation between the upturned ends 46 and downturned ends 47, of the adjacent Z conductors 49, 45 is not critical for small diameter masts of about one-sixteenth of a wavelength, separation of about one-twelfth of the wavelength gives good results; for larger masts, for example, one-sixth of a wavelength in diameter, one-tenth of a wavelength spacing was found to be good but 1/6 wavelength spacing was usable. This distance is not critical but is preferably made between one-thirtieth and one-fourth of a wavelength. The shape of the cross sections of the Z-bars, such as 44, 45 is also not critical. These members may be bars, channels of square, round or of semicircular cross sections or tubes of various shapes. For example, I used Z-bars of square cross section. Each side of the square cross section was made about 1/50th of the wavelength. This dimension is not critical, small cross sectional dimensions, however, tend to decrease the bandwidth. The approximate dimensions given are in terms of the wavelength, corresponding to the center frequency within the frequency range of the antenna.

The two similar twin-Z elements in FIG. 5, clamped to the opposite sides of a metal mast 41 may be excited in the same relative phase by two coaxial feeders receiving power from the same radio frequency source. When this is done and the baluns are poled in the same way, the currents in the horizontal portions of the Z radiators 44, 40, 49, 45 all flow clockwise or all flow counterclockwise around the mast at a given instant. Such flow of currents results in substantially omnidirectional radiation in both polarizations in the plane at right angles to the mast. In the upward and downward directions the radiation is cancelled out. The vertical patterns for vertical and horizontal polarizations are figures of eight. Horizontal patterns remain substantially omnidirectional over about 18% band with the horizontally and vertically polarized fields approximately equal to each other. Polarization is elliptical. The axial ratio is within 6 dB over about one half of the band and under 10 over the remainder of the band. Maxima and minima being in planes other than vertical and horizontal.

Figure 4:
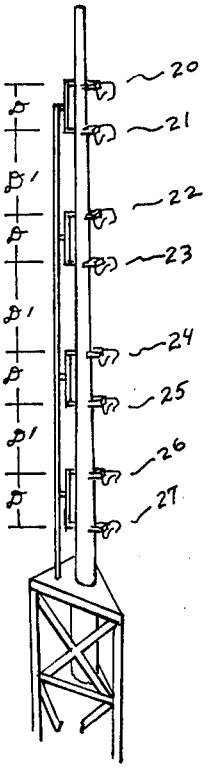
FIG. 4 shows a stacked array of antenna elements of the short helix type arranged in pairs with these pairs spaced so that two different spacings between the elements are used in the same array.

Since the vertical patterns of the antenna of FIG. 5, in all polarizations have nulls upward and downward, the spacing D between such elements in a stacked array, such as is shown in FIG. 9, has approximately the effect on the gain of the array as is shown in FIG. 8, which is similar to FIG. 4 of U.S. Pat. No. 2,289,103. The formulas which show the effect of spacing on the gain of the array in said patent are also applicable.

The central portions of the Z-radiators need not be straight but may be bent. It is also possible to tilt the central portions with respect to the horizontal and to change the right angle between the upright portions and the titled central portions of the Z-radiators. It is also possible to deform the Z-radiator into a shape of a tilted letter S which has been rotated through an angle around 90° ± 20°.

The vertical portions of the Z-radiators may be made shorter than ⅛ wavelength. When the upright portions are made shorter, the horizontal portion is made correspondingly longer to preserve the overall length. The effect of this change is a decrease in the vertical component of the radiation. Conversely, when the vertical portions are made longer, the vertical component is increased. A change in the ratio of vertical component to horizontal component can also be achieved by making the vertical portions of the Z-radiators of smaller or larger cross section than the horizontal portions.

In FIG. 10 is shown another embodiment of this invention. In this Figure three twin Z elements are arranged at 120° angular spacings around a mast 60. The three twin Z elements 61, 62, 63 are similarly poled and are excited in the same relative phases. With this arrangement, for example, using a mast about 0.3 wavelengths in diameter elliptically polarized radiation with about 4.5 dB axial ratio was obtained. The ratio of vertical component to horizontal component was almost unity and the horizontal patterns in the horizontal and vertical polarizations were triangular in shape with the signal varying about ± 1.5 dB with the azimuth angle. The dimensions of the Z-radiators were the same as those used in the antenna of FIG. 5.

FIG. 11 diagrammatically shows a method which may be used for feeding antennas of this type. This figure is a schematic top view of an antenna of FIG. 10. In FIG. 11 the antenna is supplied with power from a single coaxial feeder, the outer conductor of which is the mast itself. The baluns of the three twin-Z radiators ae capacitively coupled to the inner conductor 67 of the feeder by extending the inner conductors, 68, 69, 70 of the baluns into the space toward the inner conductor 67. Insulators such as 71 are used to exclude water from the coaxial feeder.

In a stacked array of antennas shown in FIGS. 5 and 10 all antennas may be excited in the same relative phases by being spaced one wavelength apart. The distribution of relative power may be controlled by the degree of coupling and the relative phases may be controlled by making the spacings somewhat greater or less than one wavelength as desired in order to obtain the vertical pattern of the desired shape. When spacings near a half wave are used, the baluns have to be reversed. This can be done by mounting the twin-Z radiators upside down. The inner conductor of the feeder may be terminated by the last antenna or by a resistive termination. Such a load is then called upon to dissipate relatively low power but would provide added electrical stability to the feeding system and thus would simplify the adjustment of the feeding system.

I claim:

1. A radiating element comprising:

a. Two substantially similar metal conductors each having a central portion and two end portions with the end of the central portion of one conductor located close to the end of the central portion of the other conductor, b. Said central portions arranged at an angle with each other in substantially the same plane, c. The end portions of each conductor pointing in opposite directions from the plane containing the central portions, d. The end portions of the two conductors at the proximate ends of the central portions pointing in opposite directions, e. Means for energizing the proximate ends of the central portions of the conductors at their proximate ends by radio frequency in opposite phases.

2. An omnidirectional bipolarized antenna comprising:

a. Two similar radiating elements of claim 1 arranged on opposite sides of and fastened to a common support with central portions of the four radiating conductors lying substantially in the same plane, b. Said central portions of the radiating conductors at their proximate ends subtending angles less than 180° on the side of the support, c. Means for feeding said radiating elements with radio frequency power poled to excite opposite voltages on proximate ends of the central portions of the radiating conductors.

3. An omnidirectional bipolarized antenna comprising:

a. Three similar radiating elements of claim 1 arranged at equal intervals around a common support with the central portions of the six radiating conductors lying substantially in the same plane, b. Said central portions of the radiating conductors at their proximate ends subtending angles less than 180° on the side of the support, c. Means for feeding said radiating elements with radio frequency power poled to excite opposite voltages on proximate ends of the central portions of the radiating conductors.

4. A stacked array comprising a metal mast and a plurality of antennas according to claim 2 spaced between 0.8 and 1.2 wavelengths apart.

5. A stacked array comprising a metal mast and a plurality of antennas according to claim 3 spaced between 0.8 and 1.2 wavelengths apart.

6. An antenna in accordance with claim 2 wherein the distances between the proximate ends of the central conductors is between one-fortieth and one-fifth of the wavelength.

7. An antenna in accordance with claim 3 wherein the distances between the proximate ends of the central conductors is between one-fortieth and one-fifth of the wavelength.

8. a. N Similar radiating elements of claim 1 arranged at equal intervals around a common cylindrical support, b. 2N central portions of the radiating elements lying substantially in the same plane which is substantially perpendicular to the axis of the cylindrical support, c. Said central portions of the radiating conductors at their N prominate ends subtending angles less than 180° on the side of the common support, d. Means for feeding said radiating elements with radio frequency power poled to excite opposite voltages at N proximate ends of the central portions of the radiating conductors.

9. Antenna in accordance with claim 8 wherein each radiating conductor is substantially a half wavelength long at the average radiated frequency.

10. Antenna in accordance with claim 8 wherein the central portions of the radiating conductors are substantially one quarter wavelength long at the average radiated frequency.

* * * * *